US005632721A

United States Patent [19]

Kuan

[11] Patent Number: 5,632,721

[45] Date of Patent: May 27, 1997

[54] MASSAGE APPARATUS

[76] Inventor: Yo mo Kuan, Boun-Ryo 3B, 5-8, Kami-Ohsaki 4-chome, Shinagawa-ku, Tokyo, Japan

[21] Appl. No.: 500,133

[22] Filed: Jul. 10, 1995

[30] Foreign Application Priority Data

Jul. 29, 1994 [JP] Japan ..... 6-1780707

[51] Int. Cl.[6] ..... A61H 7/00; A61H 23/00

[52] U.S. Cl. ..... 601/135; 601/119; 601/133; 601/112

[58] Field of Search ..... 601/84, 112, 118, 601/119, 133–135; 606/204, 201; 30/364, 363, 359, 358; 81/422, 424

[56] References Cited

U.S. PATENT DOCUMENTS

| | | | |
|---|---|---|---|
| 869,874 | 11/1907 | Bernard | 30/364 X |
| 2,690,746 | 10/1954 | Achberger | 601/133 |
| 4,193,191 | 3/1980 | Sisco | 30/364 |
| 4,549,536 | 10/1985 | Varjabedian | 601/133 X |
| 5,094,227 | 3/1992 | Eglauf et al. | 601/135 |

FOREIGN PATENT DOCUMENTS

| | | | |
|---|---|---|---|
| 202802 | 9/1958 | Australia | 30/364 |
| 360868 | 5/1906 | France | 30/364 |
| 352697 | 5/1922 | Germany | 30/364 |
| 471640 | 5/1952 | Italy | 30/364 |
| 2-10046 | 9/1927 | Japan . | |
| 54-130790 | 9/1979 | Japan . | |
| 5-82438 | 11/1993 | Japan . | |
| 6-22230 | 7/1994 | Japan . | |
| 5312 | 12/1893 | Sweden | 30/364 |
| 555352 | 8/1943 | United Kingdom | 30/359 |
| 8100202 | 2/1981 | WIPO | 606/204 |

*Primary Examiner*—Danton D. DeMille
*Attorney, Agent, or Firm*—Sughrue, Mion, Zinn, Macpeak & Seas

[57] ABSTRACT

A massage apparatus includes two rod members which are crossed and pivoted, and a massage member rotatably provided at a tip end portion of the rod members, the massage member having different kinds of convex and concave portions, wherein a desired part of a human body may be clamped by the massage member and the other of the rod members.

6 Claims, 3 Drawing Sheets

MASSAGE APPARATUS

BACKGROUND OF THE INVENTION

The present invention relates to a massage apparatus.

For example, Japanese Utility Model Applications Laid-Open Nos. 54-130790 and 5-82438 show massage apparatuses.

However, in these conventional massage apparatuses, massage is made by a single massage member or projection so that it is impossible to perform an effective massage in response to a part to be massaged or a level of stiffness or fatigue in the body part.

SUMMARY OF THE INVENTION

An object of the present invention is to provide a massage apparatus which may readily be used to effect a massage in response to a part to be massaged or a level of stiffness or fatigue in the body part.

According to the present invention, there is provided a massage apparatus comprising: two rod members which are crossed and pivoted; and a massage member rotatably provided at a tip end portion of one of the rod members, the massage member having different kinds of convex and concave portions, wherein a desired part of a human body may be clamped by the massage member and the other of the rod members.

The massage apparatus may further comprise splicing rod members detachably mounted on proximal portions of the two rod members.

The massage apparatus may further comprise a massage projection at least one of the two rod members or one of the splicing rod members.

The effective massage may be performed by selecting a suitable convex and/or concave portion by rotating the massage member.

DESCRIPTION OF THE PREFERRED EMBODIMENTS

Figure 1:
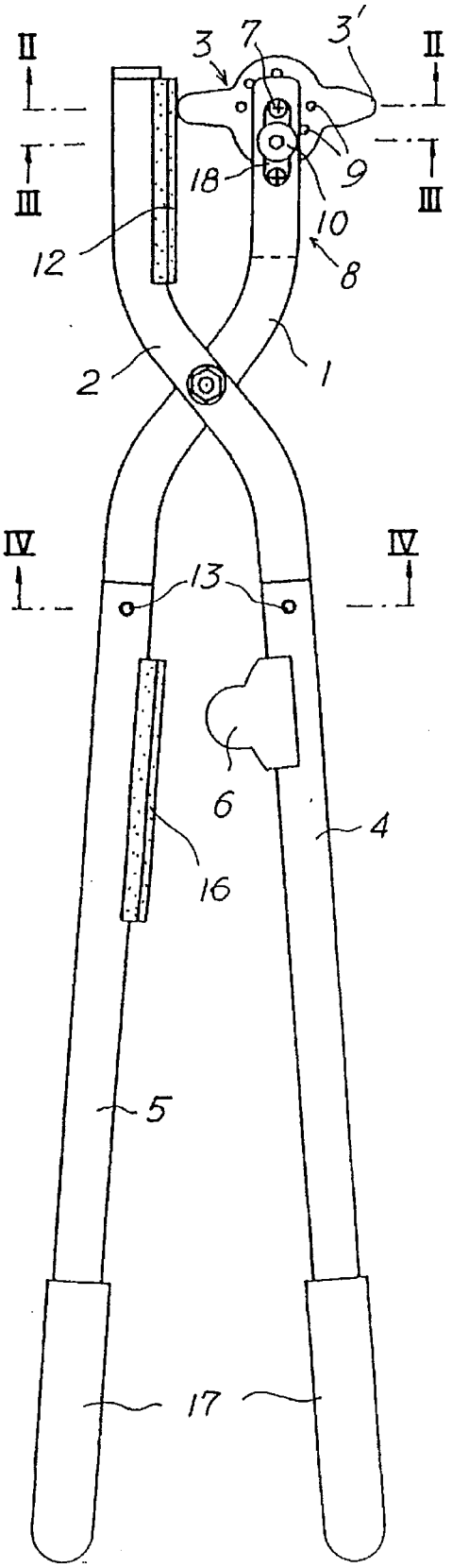
FIG. 1 is a frontal view showing a massage apparatus according to an embodiment of the invention.
Figure 2:
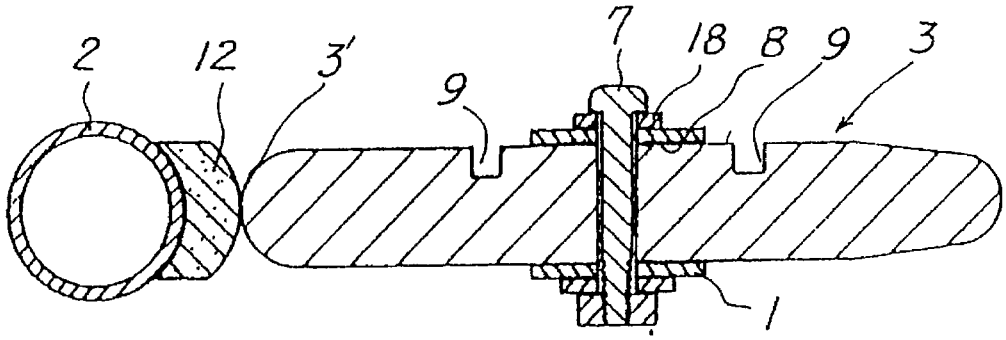
FIG. 2 is a cross-sectional view taken along the line II—II of FIG. 1.
Figure 3B:
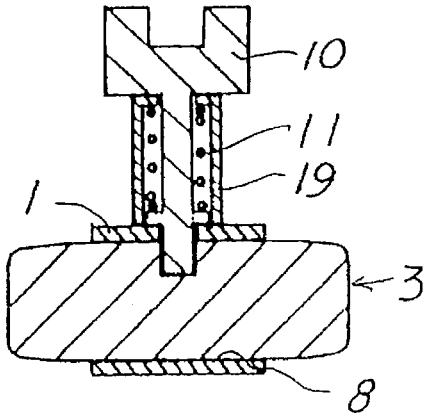
FIGS. 3A and 3B are cross-sectional views taken along the line III—III of FIG. 1.
Figure 3A:
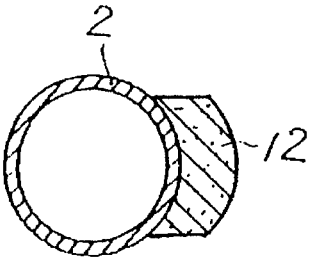

The present invention will now be described with reference to the accompanying drawings.

A pair of rod members 1 and 2 are crossed and pivoted. A massage member 3 having various kinds of convex and concave portions at its periphery is rotatably provided on an upper portion of one of the rod members 1. Incidentally, for example, a magnet is embedded in a suitable position of the massage member 3; that is, a magnet is embedded in a tip end of a projection 3' of the massage member 3 to thereby assist the massage effect with the magnetic effect.

The massage member 3 is pressingly inserted into a cutaway groove 8 formed at a tip end of the rod member 1. The massage member 3 is pivoted on a shaft 7. A plurality of holes 9 are formed in a circular manner on a surface of the massage member 3. A projectable/retractable pin member 10 to be pressingly inserted into the hole 9 is provided in the vicinity of the shaft 7. Reference numeral 18 denotes a washer, and numeral 19 denotes a sleeve portion into which a spring 11 is inserted.

The projectable/retractable pin member 10 is drawn against the spring 11, the massage member 3 is rotated through any desired angle and the projectable/retractable pin member 10 is returned back so that the massage member 3 is fastened at the position.

A soft member 12 is provided at a position facing the massage member 3 on an inner surface of the other rod member 2.

Splicing rod members 4 and 5 are detachably coupled with proximal ends of the rod members 2, 2 and 1, respectively.

Figure 4A:
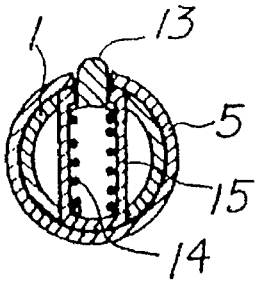
FIGS. 4A and 4B are cross-sectional views taken along the line IV—IV of FIG. 1.
Figure 4B:
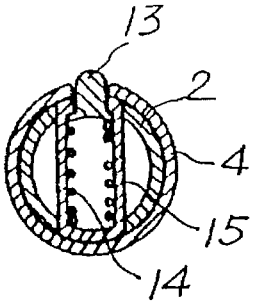

The attachment/detachment of the splicing rod members 4 and 5 may be performed by pressing downwardly or upwardly projections 13 against springs 14 by springs as shown in FIGS. 4A and 4B. Numeral 15 denotes a sleeve portion into which the spring 14 is inserted.

Also, a massage projection 6 is provided inside the splicing rod member 4, whereas a soft member 16 is provided on the other splicing rod member 5 at a position confronting the massage projection 6. Incidentally, if a magnet is embedded in a tip end of the massage projection 6, the massage effect may be enhanced by the magnet. Reference numeral 17 denotes a pair of grips.

Figure 5:
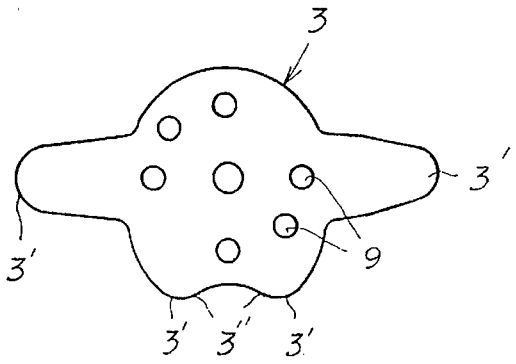
FIG. 5 is a frontal view showing a massage member according to the embodiment.

With such a structure according to the embodiment of the invention, it is possible to easily perform the massage in response to the body part to be massaged and the level of stiffness or fatigue in the body part by selecting a desired corrugation out of the convex and concave portions of the massage member 3. In particular, if a boundary portion 3" between the convex portion 3' and the concave portion as well as the convex portion 3' are selected (see FIG. 5), it is possible to effectively press the part close to the ankle.

Figure 6:
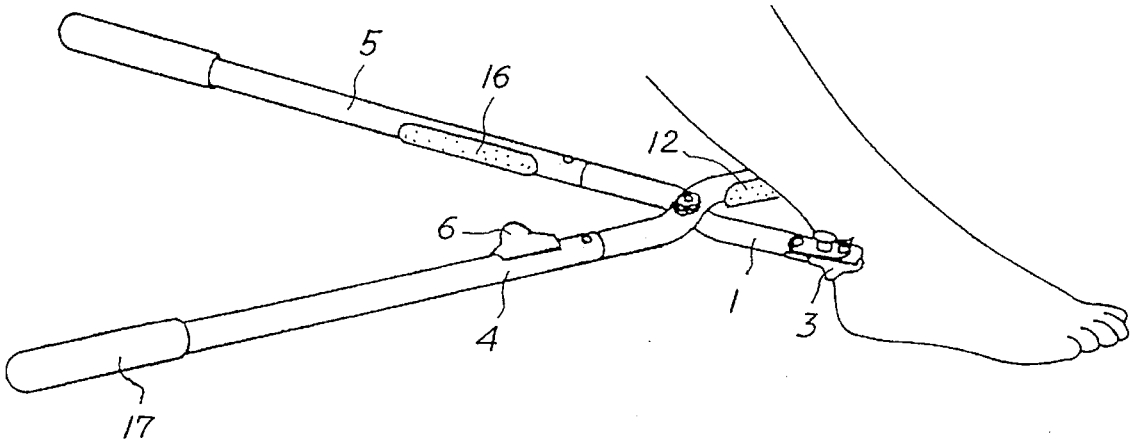
FIG. 6 is a perspective view showing a condition of the apparatus according to the embodiment in use.

Unlike the conventional apparatuses, according to the embodiment of the invention, since the X-shaped structure is taken; that is, the massage portion is located forward from the pivot portion, it is possible to effect the massage by the massage member 3 at the tip end portion as shown in, for example, FIG. 6. In this respect, with the conventional structure, it is very difficult to effect the massage at the part close to the ankle.

Furthermore, in the embodiment, it is possible to provide an excellent massage apparatus in a practical use because the massage by the massage member 3 as well as the massage projection 6 can be performed.

Also, if the splicing rod member 4 is rotated so that the massage projection 6 is located outside, it is possible to perform the massage effectively over a part from the calf to the thigh or the waist, for example, with the soft member 16 and the peripheral surface of the splicing rod member 4 where the massage projection 6 is not present.

Also, according to the embodiment, since the splicing rod members 4 and 5 may readily be removed, the massage apparatus is superior in portability.

If different kinds of massage members 3 are prepared, it is possible to enhance the value of the commercial products.

As described above, the massage which should be effected by other persons may be performed by the user himself or herself.

With such a structure, it is possible to provide a massage apparatus which is excellent in facilitating the massage in response to the body part to be massaged or the level of stiffness or fatigue in the body part.

What is claimed is:

1. A massage apparatus comprising:

two rod members, each having a tip end and an other end, which are crossed and pivoted at a pivot;

a massage member rotatably provided at the tip end of one of said rod members, said massage member having at least one convex portion and at least one concave portion;

two splicing rod members detachably mounted on the other ends of said two rod members; and projections which are disposed at the other end of each of said two rod members, each of said projections being projectable/retractable by a spring catch means for resiliently urging said projection into a recess formed in each of said splicing rod members to thereby make said splicing rod members be detachably mounted to a respective one of said two rod members;

wherein a desired part of a human body may be clamped by the massage member and the other of said rod members.

2. The massage apparatus according to claim 1, wherein said massage member has a plurality of holes circularly formed therein, said massage apparatus further comprising:

a projectable/retractable pin member disposed at said tip end portion of said one of said rod members, said pin member connected to a bias spring for causing said pin member to be inserted into one of said holes to secure said massage member in a fixed position.

3. The massage apparatus according to claim 1, said massage apparatus further comprising:

a soft member disposed on the other of said rod members, distal of said pivot, wherein said soft member is opposite said massage member.

4. The massage apparatus according to claim 1, said massage apparatus further comprising:

a passage projection disposed on one of said splicing rod members; and a soft member disposed on the other of said splicing rod members, wherein said soft member is opposite said massage projection.

5. A massage apparatus comprising:

two rod members, each having a tip end and an other end, which are crossed and pivoted at a pivot;

a massage member rotatably provided at the tip end of one of said rod members, said massage member having at least one convex portion, at least one concave portion, and a plurality of holes circularly formed therein;

a first soft member disposed on the other of said rod members, near the tip end thereof, wherein said first soft member is opposite said massage member;

a projectable/retractable pin member disposed at said tip end of said one of said rod members, said pin member connected to a bias spring for causing said pin member to be inserted into one of said holes to secure said massage member in a fixed position;

two splicing rod members detachably mounted on the other ends of said two rod members;

a massage projection disposed on one of said splicing rod members;

a second soft member disposed on the other of said splicing rod members, wherein said second soft member is opposite said massage projection; and projections which are disposed at the other ends of each of said two rod members, each of said projections being projectable/retractable by a spring catch means for resiliently urging said projection into a recess formed in each of said splicing rod members to thereby make said splicing rod members be detachably mounted to a respective one of said two rod members; and wherein a desired part of a human body may be clamped by the massage member and the other of said rod members.

6. A massage apparatus comprising:

two rod members, each having a tip end and an other end, which are crossed and pivoted at a pivot;

a massage member rotatably provided at the tip end of one of said rod members, said massage member having at least one convex portion and at least one concave portion;

a pin member on said one of said rod members which engages said massage member to stop rotation thereof and fix said massage member at a predetermined position;

two splicing rod members detachably mounted on the other ends of said two rod members; and projections which are disposed at the other ends of each of said two rod members, each of said projections being projectable/retractable by a spring catch means for resiliently urging said projection into a recess formed in each of said splicing rod members to thereby make said splicing rod members be detachably mounted to a respective one of said two rod members;

wherein a desired part of a human body may be clamped by the massage member and the other of said rod members.

* * * * *

UNITED STATES PATENT AND TRADEMARK OFFICE

CERTIFICATE OF CORRECTION

PATENT NO.: 5,632,721
DATED: May 27, 1997
INVENTOR(S): Yo-mo KUAN

It is certified that error appears in the above-identified patent and that said Letters Patent is hereby corrected as shown below:

Title page, item [30], delete "6-1780707" and insert --6-178707--;

Col. 1, line 12, after "response to a" insert --body--;

Col. 1, line 19, after "response to a" insert --body--;

Col. 2, line 19, delete "2,"; and

Claim 4, line 3, delete "passage" and insert --massage--.

Signed and Sealed this

Thirteenth Day of April, 1999

*Attest:*

Q. TODD DICKINSON

*Attesting Officer*

*Acting Commissioner of Patents and Trademarks*